US010709239B2

(12) United States Patent
Guizzardi et al.

(10) Patent No.: US 10,709,239 B2
(45) Date of Patent: Jul. 14, 2020

(54) ASSEMBLABLE MODULAR WARDROBE MADE OF PLASTIC MATERIAL

(71) Applicant: TERRY STORE-AGE S.P.A., Milan (IT)

(72) Inventors: Massimo Guizzardi, Bareggio (IT); Ottavio Di Blasi, Milan (IT)

(73) Assignee: TERRY STORE-AGE S.P.A., Milan (IT)

( * ) Notice: Subject to any disclaimer, the term of this patent is extended or adjusted under 35 U.S.C. 154(b) by 109 days.

(21) Appl. No.: 16/068,869

(22) PCT Filed: Nov. 15, 2016

(86) PCT No.: PCT/EP2016/077650
§ 371 (c)(1),
(2) Date: Jul. 9, 2018

(87) PCT Pub. No.: WO2017/133802
PCT Pub. Date: Aug. 10, 2017

(65) Prior Publication Data

US 2019/0021490 A1 Jan. 24, 2019

(30) Foreign Application Priority Data

Feb. 1, 2016 (IT) ..... 202016000009930

(51) Int. Cl.
*A47B 47/05* (2006.01)
*A47B 61/00* (2006.01)

(52) U.S. Cl.
CPC ..... *A47B 47/05* (2013.01); *A47B 61/00* (2013.01)

(58) Field of Classification Search
CPC ..... A47C 19/005; A47C 19/02; A47C 19/021; A47C 19/025; F16B 12/02; F16B 12/125;
(Continued)

(56) References Cited

U.S. PATENT DOCUMENTS 3,877,765 A * 4/1975 Hassing ..... A47B 47/00 312/265.4
4,003,172 A * 1/1977 Pawl ..... E04B 2/08 52/279

(Continued)

FOREIGN PATENT DOCUMENTS

CA 2982256 * 10/2016
WO 2013080020 A1 6/2013
WO 2018114438 * 6/2018

OTHER PUBLICATIONS

International Search Report dated Feb. 21, 2017 during the prosecution of International Patent Application No. PCT/EP2016/077650.

*Primary Examiner* — Janet M Wilkens
(74) *Attorney, Agent, or Firm* — Troutman Sanders LLP

(57) ABSTRACT

The invention relates to a modular wardrobe made of plastic material, comprising an assemblable reinforcement structure (15), where said assemblable reinforcement structure (15) comprises a pair of lateral cross-members (24), where each of the aforementioned lateral cross-members (24) is connectable to a connection cross-member (28) to form a stiffening structure (17) for the wardrobe (10) and where an L-shaped support (23) is further provided for sustaining shelves (61, 62) of the wardrobe (10), said L-shaped support (23) comprising a portion for connecting the connection cross-member (28) to a vertical upright (22) for forming said assemblable structure (15). The provision of the L-shaped support (23) allows one or the other shelf portion (61 or 62) to be selectively removed without having to use an upright for supporting the remaining shelf and hence increasing flexibility when using the wardrobe.

10 Claims, 8 Drawing Sheets

(58) Field of Classification Search
CPC .... F16B 2012/046; F16B 12/54; F16B 12/56; F16B 12/58; A47B 47/05; A47B 61/00; A47B 47/047; A47B 47/042
USPC ..... 52/590.1, 655.1, 702, 289, 282.1, 285, 52/286, 288, 290, 296; 312/351, 107, 312/108, 111, 257.1, 263, 265.1–265.6
See application file for complete search history.

(56) References Cited

U.S. PATENT DOCUMENTS 4,019,298 A * 4/1977 Johnson, IV ..... E04B 1/185 52/590.1
4,426,120 A * 1/1984 Johnson ..... F24F 3/0442 206/321
5,522,101 A * 6/1996 Yeh ..... A47C 19/005 403/334
5,975,660 A * 11/1999 Tisbo ..... A47B 47/045 312/108
6,047,838 A * 4/2000 Rindoks ..... A47B 96/145 211/187
6,202,867 B1 * 3/2001 Di Blasi ..... A47B 47/0075 108/138
D591,076 S * 4/2009 Guizzardi ..... D6/671.1
9,084,484 B2 * 7/2015 Vilkomirski ..... A47B 87/0215
2002/0171332 A1 * 11/2002 Skov ..... A47B 87/0276 312/107
2003/0136311 A1 * 7/2003 Guimil ..... A47B 21/00 108/50.02
2013/0134842 A1 5/2013 Kassanoff
2013/0327256 A1 * 12/2013 Glenn, II ..... A47B 13/00 108/50.02
2016/0166059 A1 * 6/2016 Zohar ..... A47B 81/02 312/257.1
2018/0092466 A1 * 4/2018 Harrow ..... A47C 19/005

* cited by examiner

ASSEMBLABLE MODULAR WARDROBE MADE OF PLASTIC MATERIAL

CROSS-REFERENCE TO RELATED APPLICATIONS

This is a U.S. national phase application under 35 U.S.C. § 371 of International Patent Application No. PCT/EP2016/077650, filed Nov. 15, 2016, and claims benefit of priority to Italian Patent Application No. 202016000009930, filed Feb. 1, 2016. The entire contents of these applications are hereby incorporated by reference.

FIELD OF TECHNOLOGY

The present invention relates to an assemblable modular wardrobe made of plastic material.

Assemblable wardrobes are known to be formed by an upper panel, a lower panel, side panels and a rear panel which are closable by means of front doors.

BACKGROUND

Such wardrobes envisage one or more horizontal shelves inside them, where said shelves are sustained by fixed or removable supports positioned on the inside surface of the rear panel and/or the side panels.

A problem of such embodiments comes from the fact that the weight of the items placed on the shelves tends to be discharged onto the supports of the shelf itself and therefore on the wardrobe panels which, in some cases, can be deformed or bent under this effect.

SUMMARY

An object of the invention is to provide an assemblable modular wardrobe structured in such a way as to prevent the deformation of the panel due to the forces acting on the internal shelves of the wardrobe itself.

Another object of the invention is to obtain the aforementioned results in a practical and cost-effective way.

Said objects are achieved thanks to a wardrobe made of plastic material, comprising an assemblable reinforcement structure, where said assemblable reinforcement structure comprises a pair of lateral cross-members, where each of the aforementioned lateral cross-members is connectable to a connection cross-member to form a stiffening structure for the wardrobe and where an L-shaped support is further provided for sustaining shelves of the wardrobe, said L-shaped support comprising a portion for connecting the connection cross-member to a vertical upright for forming said assemblable structure.

An advantage of this embodiment comes from the fact that the weight supported by the shelves sustained by the L-shaped support is discharged on the reinforced structure comprising the vertical upright, the connection cross-member and the lateral cross-members so as to prevent the deformation of the rear panels of the wardrobe.

BRIEF DESCRIPTION OF DRAWINGS

Further characteristics of the invention can be inferred from the dependent claims. Further characteristics and advantages will be evident from reading the following description by way of non-limiting example with the aid of the figures illustrated in the appended drawings, where:

DETAILED DESCRIPTION

With particular reference to the appended figures, an assemblable wardrobe is highlighted, indicated overall with reference number 10, and made of plastic material.

Figure 1:
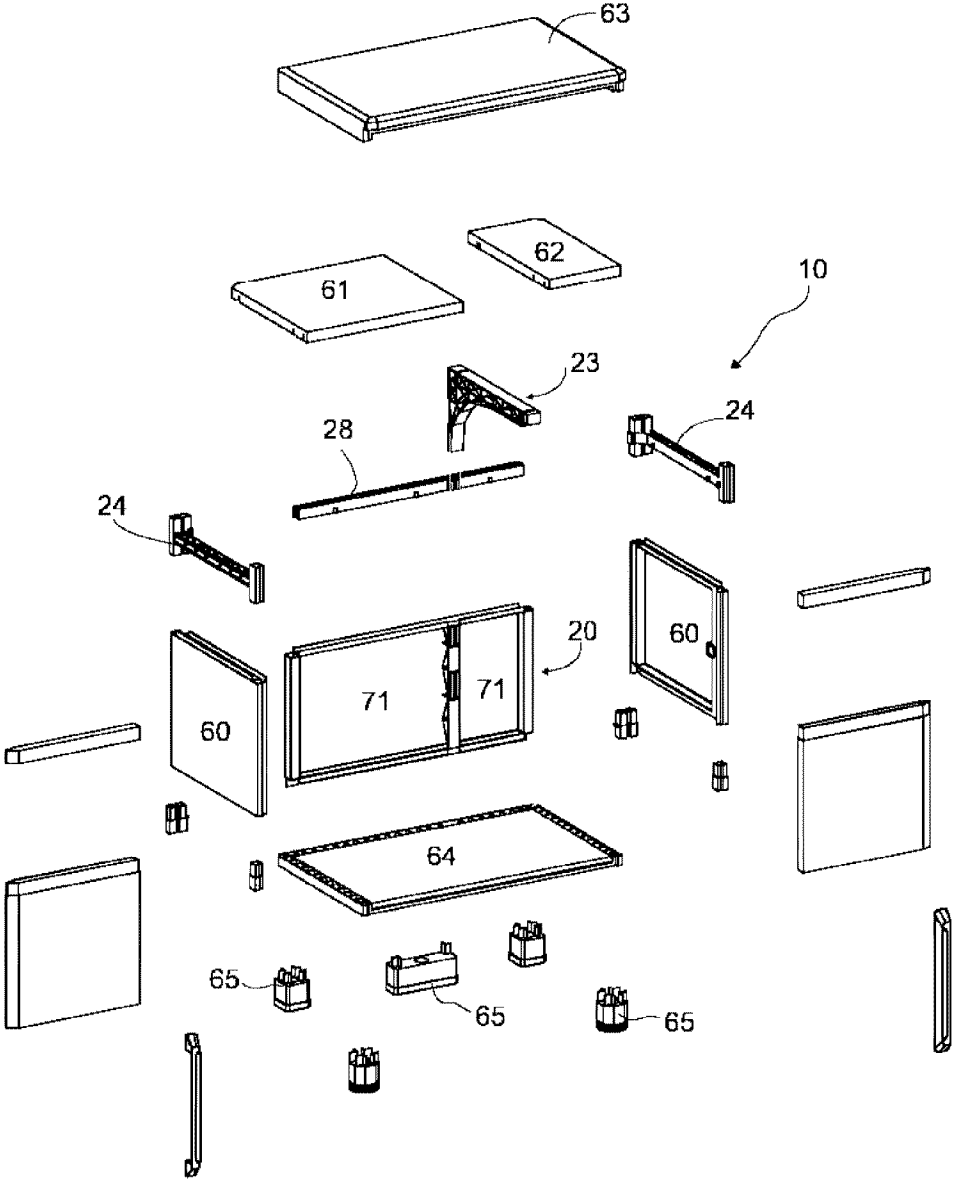
FIG. 1 is an exploded view of an embodiment of the assemblable wardrobe with a reinforced structure according to the invention.

As shown in the exploded view of FIG. 1, the wardrobe 10 comprises at least one assemblable reinforcement structure 15 which allows the support of component elements of the wardrobe 10, such as the side panels 60, an upper panel 63 (also visible in FIG. 8), as well as one or more levels of horizontal shelves 61,62, for supporting items inside the wardrobe 10, as better illustrated below.

Figure 2:
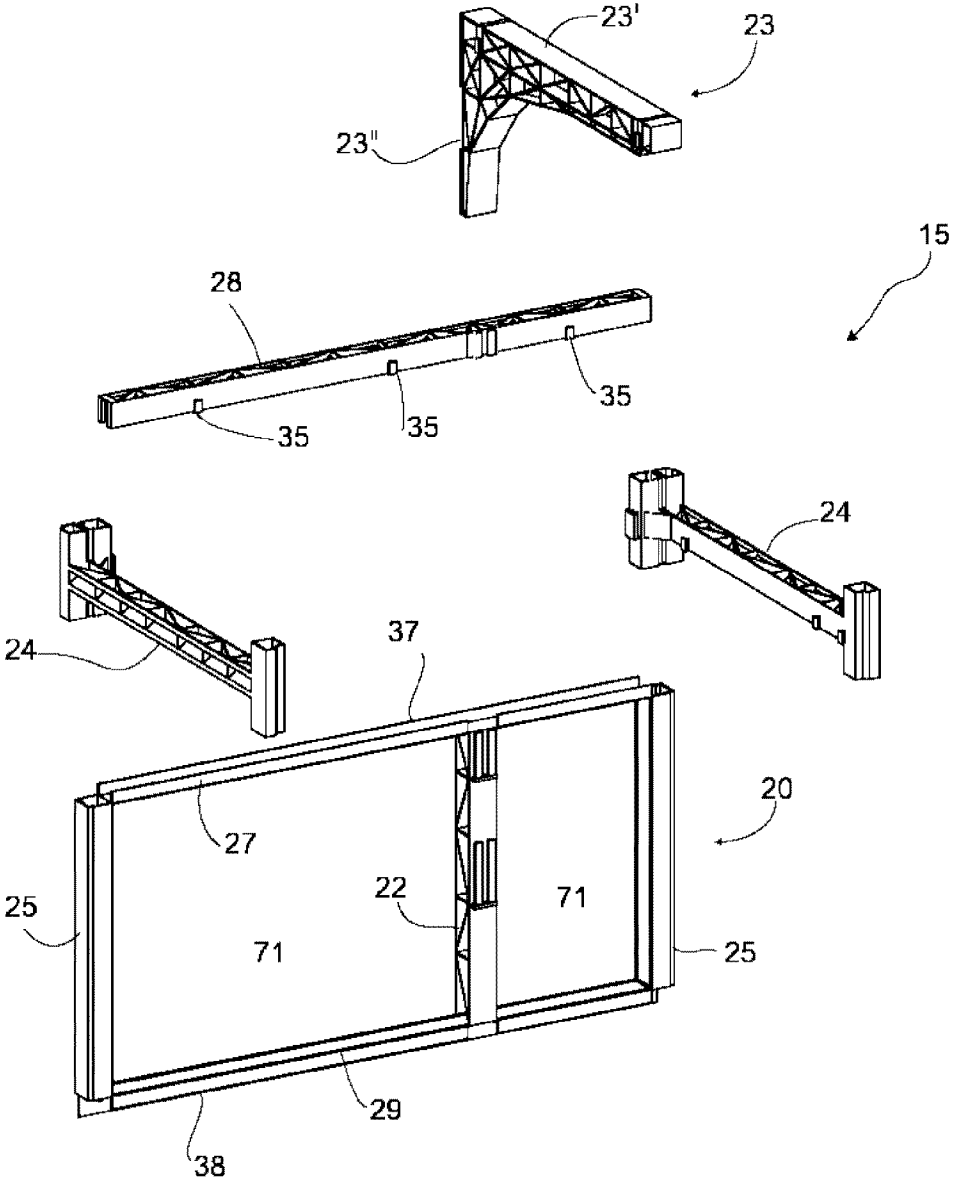
FIG. 2 is an exploded view of some components of the reinforcement structure of the assemblable wardrobe of FIG. 1.
Figure 3:
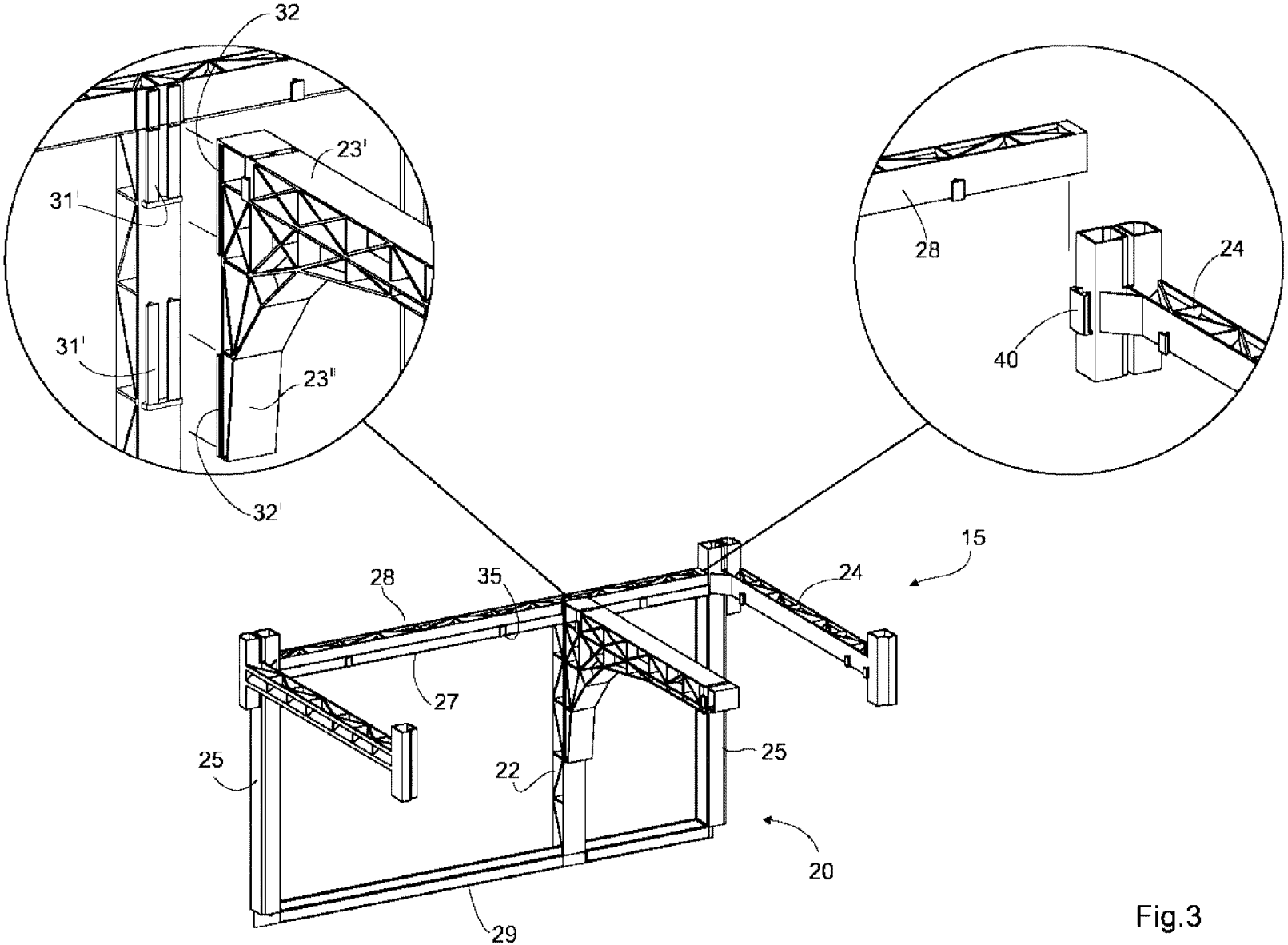
FIG. 3 illustrates, in an axonometric view, some details of the reinforcement structure of the assemblable wardrobe of FIG. 1.

The assemblable reinforcement structure 15 comprises a pair of lateral cross-members 24, where each of the lateral cross-members 24 is connectable to a connection cross-member 28 for forming together with the lateral cross-members 24 themselves a stiffening structure 17 for the wardrobe 10 substantially having a C-shape, such as in FIGS. 2 and 3.

Figure 4:
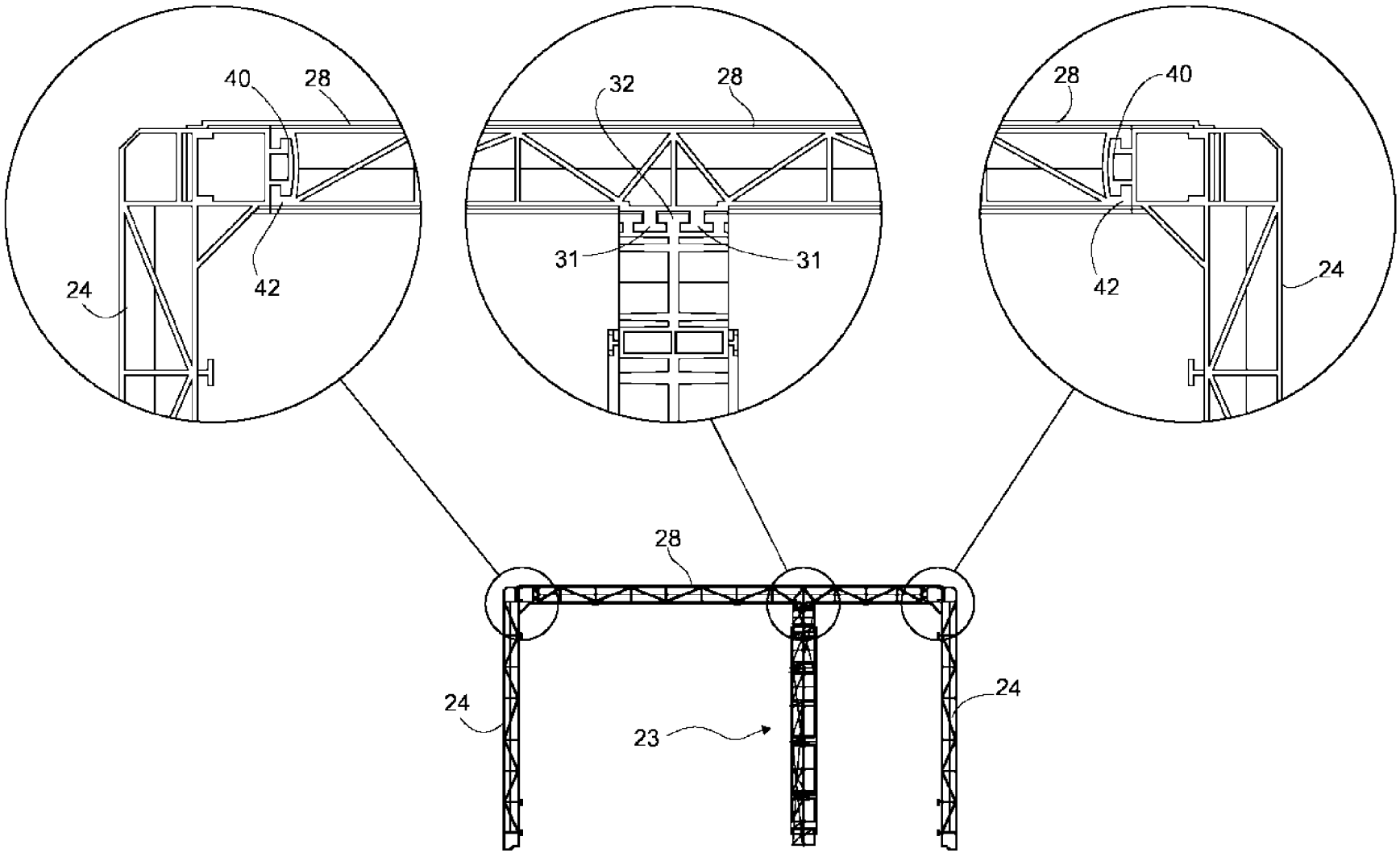
FIG. 4 illustrates, in plan view, some details of the reinforcement structure of the assemblable wardrobe of FIG. 1.
Figure 5:
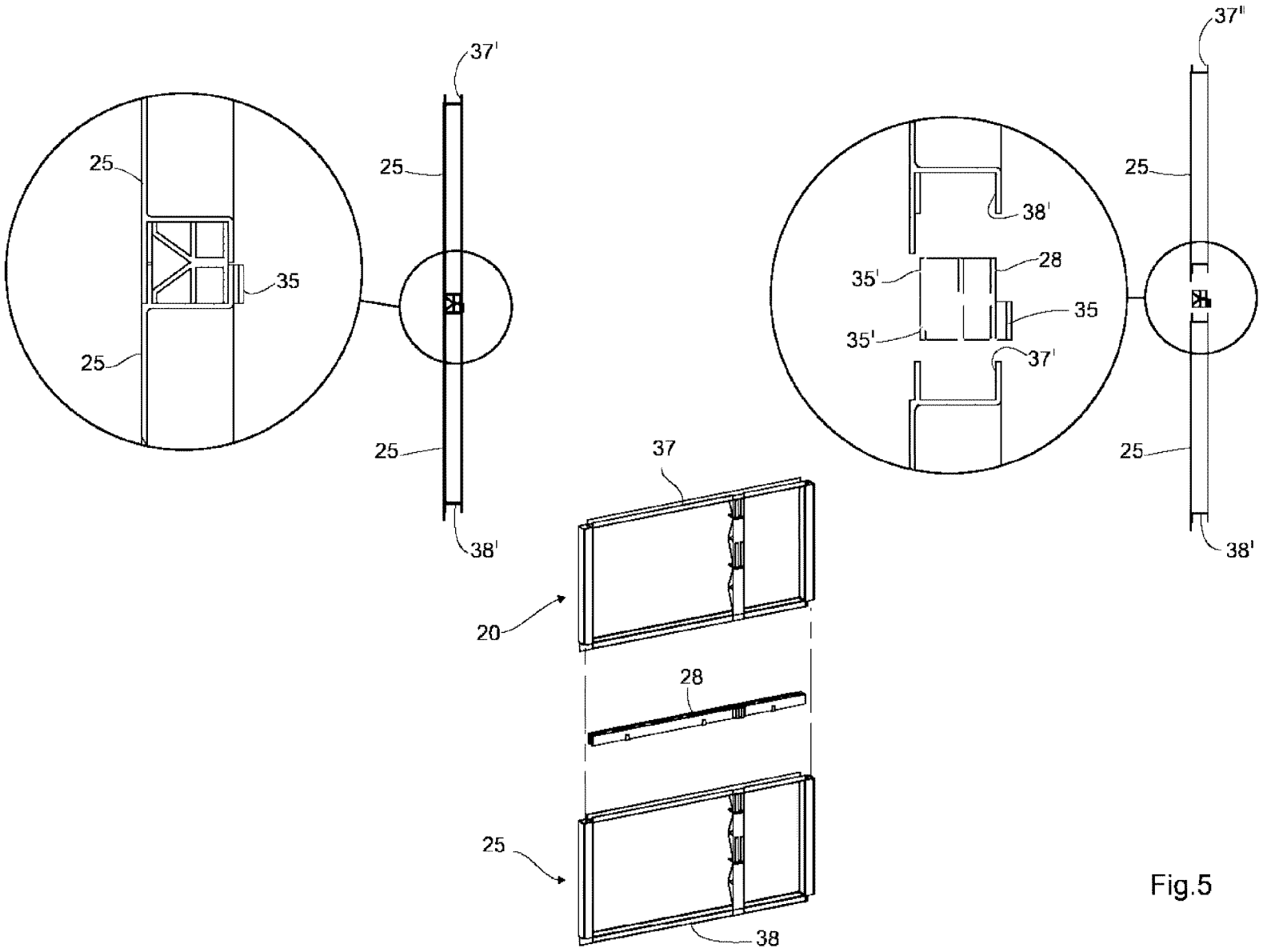
FIG. 5 illustrates, in a lateral view, some details of the reinforcement structure of the assemblable wardrobe of FIG. 1.

In particular, the connection cross-member 28 may be connected at its own ends to the lateral cross-members 24 through the engagement of grooved couplings 40 of the lateral cross-members 24 in corresponding seats 42 afforded at the ends of the connection cross-member 28, as visible for example in the details on the right and left of FIG. 4.

Alternatively (not shown in the figures) the connection of the connection cross-member 28 with the lateral cross-members 24 may be performed through the engagement of grooved couplings on the connection cross-member 28 itself with seats afforded in the lateral cross-members 24.

Once the stiffening structure 17 is mounted, it forms a sort of belt that surrounds the wardrobe 10 on three sides, leaving the fourth side free for access doors to the internal compartments of the wardrobe 10.

Preferably, the lateral cross-members 24 and the connection cross-member 28 are formed by reticular structures.

Furthermore, the assemblable structure 15 further comprises an L-shaped support 23 adapted to sustain the shelves 61,62 of the wardrobe 10.

Preferably, the L-shaped support 23 is formed by a reticular structure made of plastic material and comprises a horizontal portion 23' and a vertical portion 23". The L-shaped support 23 is connected to the connection cross-member 28 through the engagement of grooved couplings 32 provided on its vertical portion 23" with corresponding grooved couplings 31 of the connection cross-member 28 as shown for example in the central detail of FIG. 4.

The assemblable structure 15 further comprises a vertical upright 22 to which the L-shaped support 23 can be connected, for example through the engagement of grooved couplings 32' provided on the vertical portion 23" of the L-shaped support 23 with corresponding grooved couplings 31' of the vertical upright 22, as shown for example in the detail on the left of FIG. 3.

Preferably, the vertical upright 22 is comprised within a frame 20 and forms with the frame 20 itself a reticular structure made of plastic material, made of a single part.

More in particular, the frame 20 is formed by a pair of lateral uprights 25 connected to one another by an upper cross-member 27 and by a lower cross-member 29 to form a substantially rectangular shaped structure (FIG. 2).

The vertical upright 22 of the frame 20 is within a space defined by the frame 20 itself and connects the upper cross-member 27 with the lower cross-member 29 of the frame 20 itself.

The connection cross-member 28 can also be connected to the frame 20 through couplings 35 that engage in a corresponding seat 37 provided along the upper cross-member 27 of the frame 20.

Figure 6:
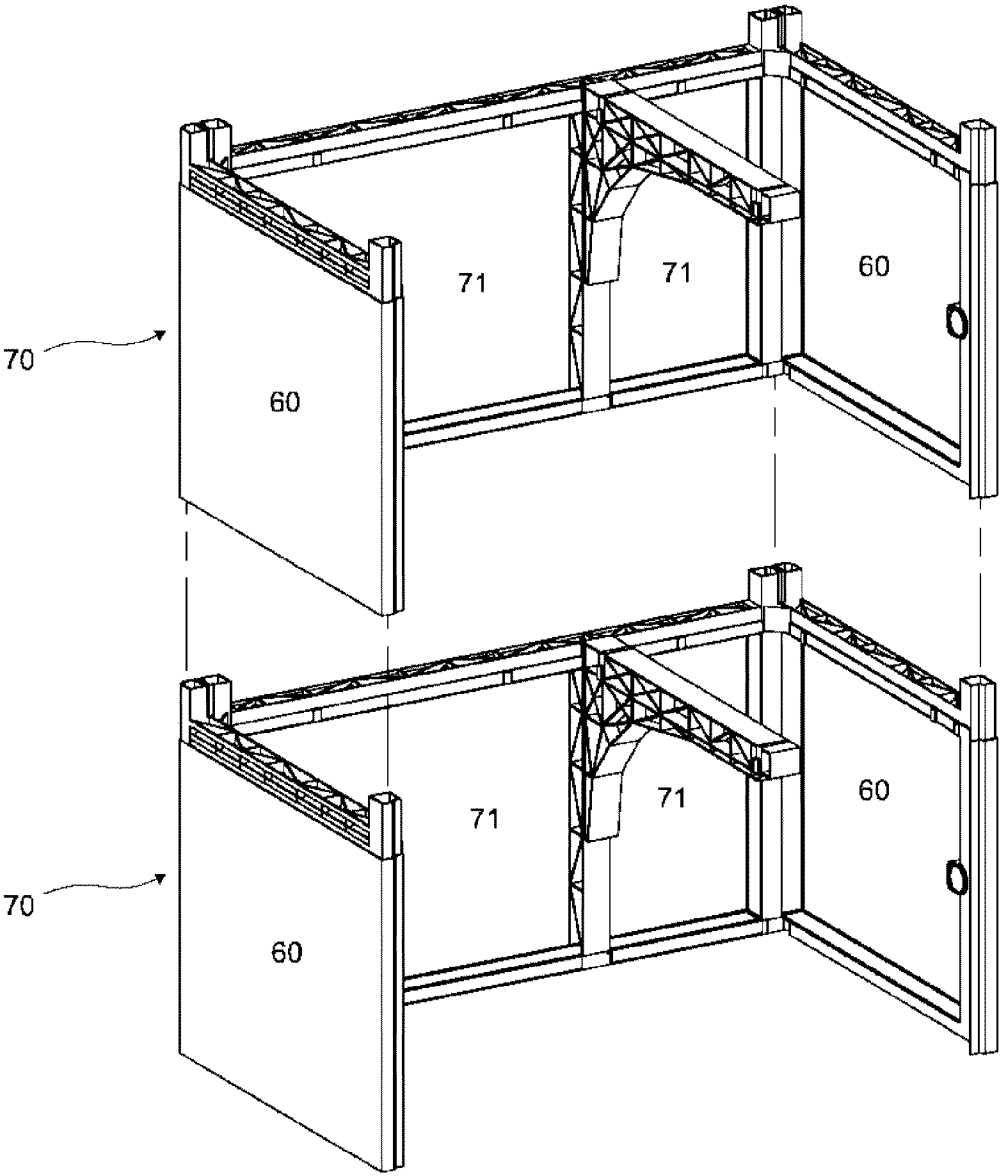
FIG. 6 illustrates, in an axonometric view, two component elements of the assemblable wardrobe of FIG. 1 and the reinforcement structure thereof.
Figure 7:
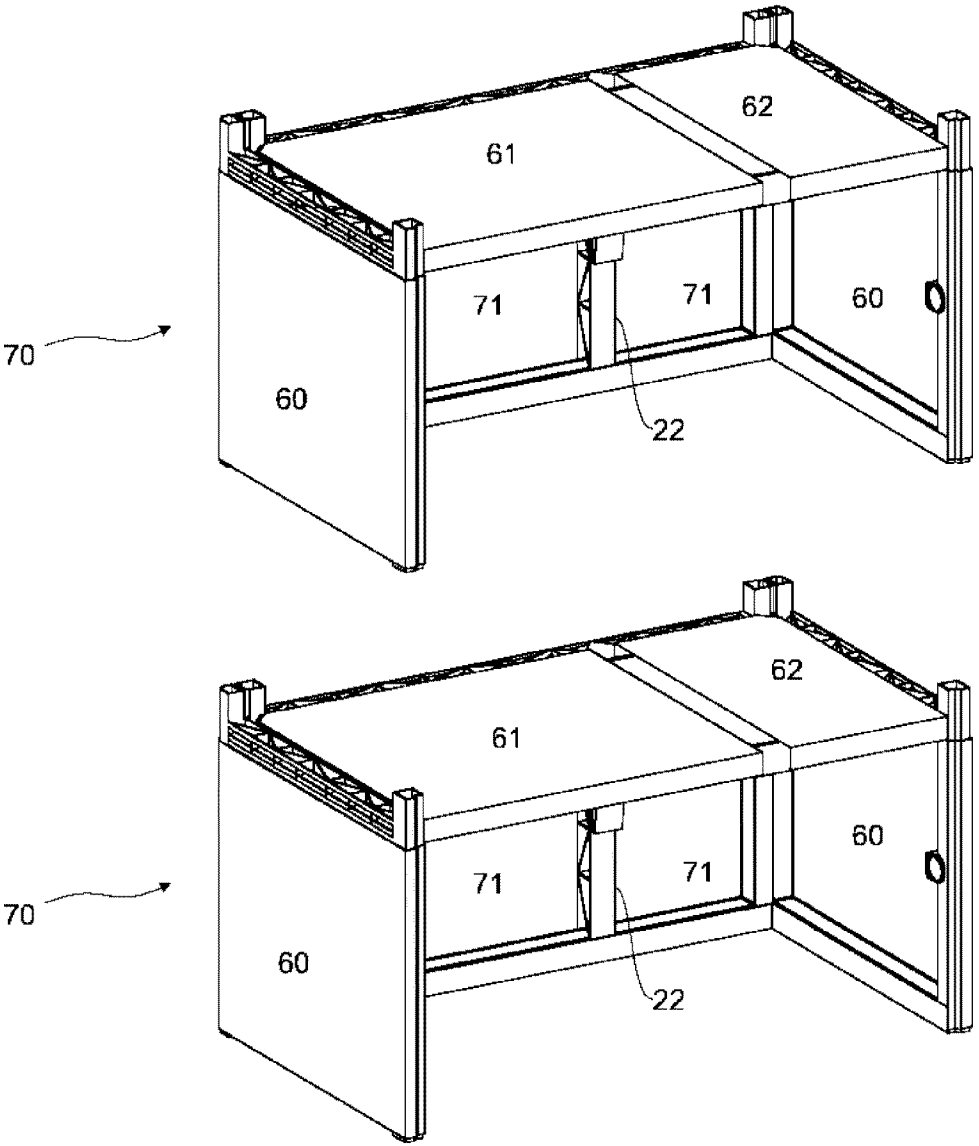
FIG. 7 illustrates, in an axonometric view, two component elements of the assemblable wardrobe of FIG. 1, equipped with support surfaces.

The wardrobe 10 may also be comprised of various assemblable modules 70, where each assemblable module 70 comprises an assemblable structure 15 to which the lateral panels 60, a rear panel 71 and shelves 61,62 are fixed (FIG. 6). If there are various superimposed assemblable modules 70 present, the connection cross-member 28 can be connected to the frame 20 above it through the engagement of the connection cross-member 28 itself in a corresponding seat 38' provided along the lower cross-member 29 of such frame 20.

Furthermore, the connection cross-member 28 is constrained at its ends to an upper portion of the lateral uprights 25 of the frame 20 through couplings 35' that are engaged in corresponding seats 37' provided in the upper portion of the lateral uprights 25.

In the same way, if there are various superimposed assemblable modules 70 present, the connection cross-member 28 is constrained at its ends to a lower portion of the lateral uprights 25 of the frame 20 through the engagement of the connection cross-member 28 itself with corresponding seats 38' provided in the lower portion of the lateral uprights 25 of the frame 20.

In the assembly of the wardrobe 10, it is possible to connect the lateral cross-members 24 to the connection cross-member 28 (as shown in particular on the right of FIG. 3) for configuring the stiffening structure 17 in that way.

The L-shaped support 23 is connected at its vertical portion 23" to the connection cross-member 28, according to the methods described above thus configuring, together with the C-shaped stiffening structure 17, the assemblable structure 15.

Finally, it is possible to connect the L-shaped support 23 to the vertical reinforcement upright 22 of the frame 20 and to rest the connection cross-member 28 on the upper cross-member 27 of the frame 20 to which it is constrained through the couplings 35 so that the horizontal portion 23' of the L-shaped support 23 can act as a support for shelves 61,62 of the wardrobe.

The ends of the connection cross-member 28 are instead connected to the lateral uprights 25 of the frame 20 as described above.

Figure 8:
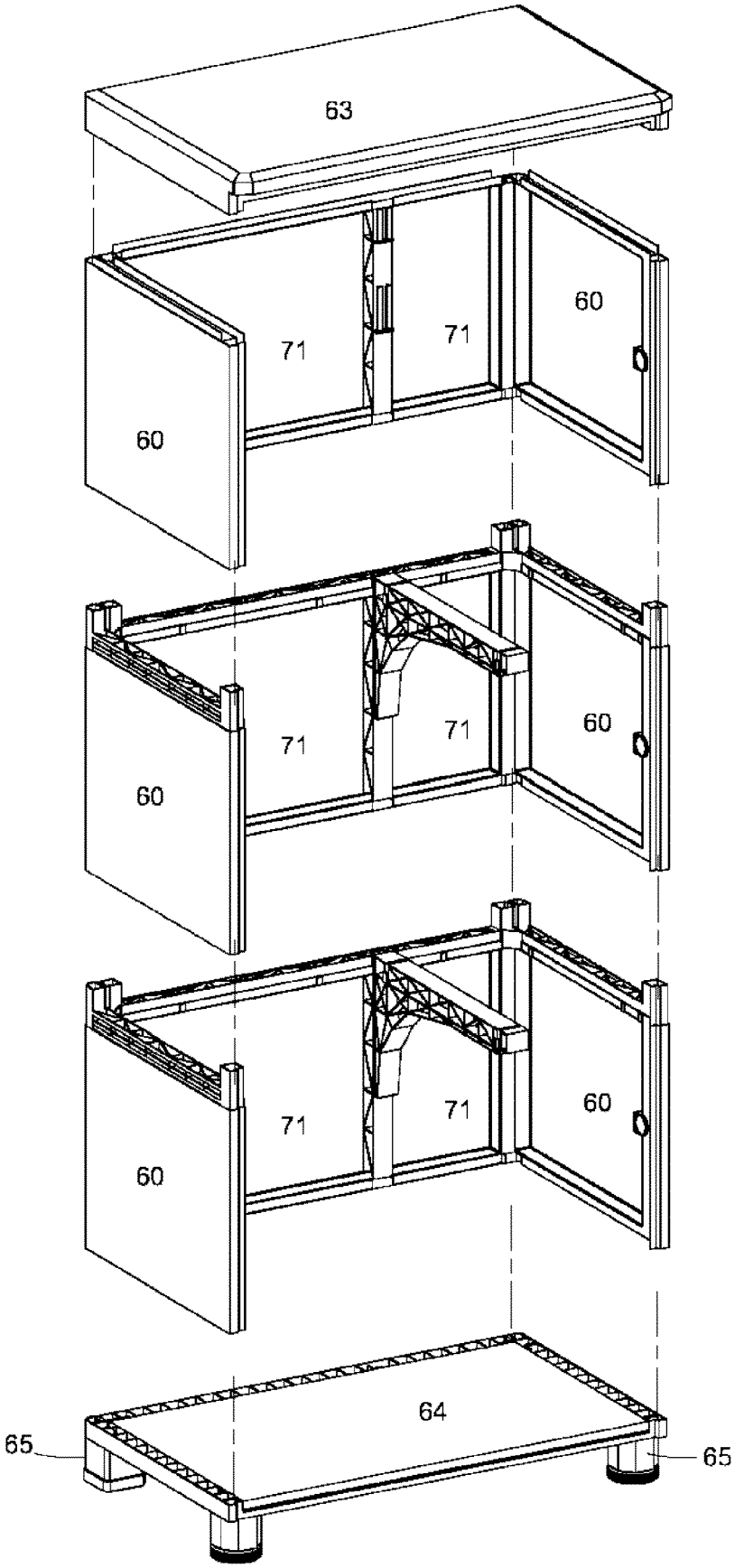
FIG. 8 is an exploded view of some components of the assemblable wardrobe according to the invention.

Finally, FIG. 8 is an exploded view of some components of the assemblable wardrobe 10 according to the invention, including the upper panel 63, the lower panel 64 and the support feet 65.

It is to be noted that, from the above, it emerges that the invention allows a portion of shelf (61 or 62) to be removed without having to use an upright for supporting the remaining shelf and therefore allowing double flexibility in the use of the wardrobe 10 being able to remove the shelf 61, the shelf 62 or even the L-shaped support 23 as required and always guaranteeing sufficient capacity for the shelf 61 (or 62) without needing to use additional uprights that would reduce the usability of the wardrobe 10.

Obviously, changes or improvements could be made to the invention as described, dictated by incidental or special reasons, but without deviating from the scope of the invention as claimed below.

The invention claimed is:

1. A wardrobe made of plastic material, comprising an assemblable reinforcement structure, where said assemblable reinforcement structure comprises a pair of lateral cross-members, where each of the aforementioned lateral cross-members is connectable to a connection cross-member to form a stiffening structure for the wardrobe and where an L-shaped support is further provided for sustaining shelves of the wardrobe, said L-shaped support comprising a portion for connecting the connection cross-member to a vertical upright for forming said assemblable structure, wherein the L-shaped support is connected to the connection cross-member through engagement of grooved couplings with corresponding grooved couplings of the connection cross-member.

2. The wardrobe according to claim 1, wherein the wardrobe comprises a plurality of assemblable modules, where each assemblable module comprises one of the assemblable structures to which lateral panels, a rear panel and shelves are fixed.

3. The wardrobe according to claim 1, wherein the connection cross-member is connected at its own ends to the aforementioned lateral cross-members through joint coupling.

4. The wardrobe according to claim 1, wherein the L-shaped support is connected to vertical upright through engagement of grooved couplings with corresponding grooved couplings of the vertical upright.

5. The wardrobe according to claim 1, wherein the lateral cross-members, the connection cross-member and the L-shaped support are formed by reticular structures.

6. The wardrobe according to claim 1, wherein vertical upright is comprised within a frame comprising two lateral uprights, an upper cross-member and a lower cross-member and forms with the frame itself a reticular structure made of plastic material made of a single part.

7. The wardrobe according to claim 6, wherein the connection cross-member is connected to the frame through couplings that engage in a corresponding seat provided along the upper cross-member of the frame.

8. The wardrobe according to claim 6, wherein the lower cross-member of the frame has a seat adapted to contain a portion of the connection cross-member.

9. The wardrobe according to claim 6, wherein the connection cross-member is constrained at its ends to an upper portion of the lateral uprights of the frame through couplings that are engaged in corresponding seats provided in the upper portion of the lateral uprights of the frame.

10. The wardrobe according to claim 6, wherein a lower portion of the lateral uprights of the frame has a seat adapted to contain a portion of the connection cross-member.

* * * * *